US005283389A

United States Patent [19]

Matsuda

[11] Patent Number: 5,283,389

[45] Date of Patent: Feb. 1, 1994

[54] DEVICE FOR AND METHOD OF DETECTING AND SUPPLYING CHORD AND SOLO SOUNDING INSTRUCTIONS IN AN ELECTRONIC MUSICAL INSTRUMENT

[75] Inventor: Toshinori Matsuda, Iwata, Japan

[73] Assignee: Kawai Musical Inst. Mgf. Co., Ltd., Sizuoka, Japan

[21] Appl. No.: 870,087

[22] Filed: Apr. 17, 1992

[30] Foreign Application Priority Data

Apr. 19, 1991 [JP] Japan ..... 3-088515

[51] Int. Cl.[5] ..... G10H 7/00; G10H 1/38

[52] U.S. Cl. ..... 84/637

[58] Field of Search ..... 84/609, 613, 634, 637, 84/666, 669, DIG. 22

[56] References Cited

U.S. PATENT DOCUMENTS 4,499,807 2/1985 Ishida ..... 84/DIG. 22 X
4,534,257 8/1985 Mitarai ..... 84/DIG. 22 X
4,614,983 9/1986 Usami .
4,633,751 1/1987 Fukaya et al. ..... 84/DIG. 22 X
4,664,010 5/1987 Sestero .
5,153,361 10/1992 Kozuki ..... 84/613

*Primary Examiner*—William M. Shoop, Jr.
*Assistant Examiner*—Jeffrey W. Donels

[57] ABSTRACT

According to the invention, a new sounding operation changes a solo being played, and various ways of sounding musical tones are permitted by a selection of whether or not a chord being played is to be changed. In response to an instruction for sounding a musical tone, chord tone data is provided together with tone data indicating a single key number, to thereby determine whether or not the chord is to be detected, and whether or not chord tone data is be output. Accordingly, ways of sounding musical tones, such as changing a chord being played together with a solo being played, or not changing a chord being played but changing only the solo being played.

20 Claims, 5 Drawing Sheets

FIG. 3

CHORD TABLE 11

| CHORD | CHORD BIT PATTERN DATA |
|---|---|
| Major | 0000 1001 0001 |
| Minor | 0000 1000 1001 |
| 7th | 0100 0001 0001<br>0100 1001 0001 |
| Minor 7th | 0100 0000 1001<br>0100 1000 1001 |
| Major 7th | 1000 0001 0001<br>1000 1001 0001 |
| Flat5 | 0000 0101 0001 |
| m7 Flat5 | 0100 0100 1001 |
| minor maj7 | 1000 1000 1001 |
| sus4 | 0000 1010 0001 |
| 7th sus4 | 0100 1010 0001 |
| add9 | 0000 1001 0101 |
| minor add9 | 0000 1000 1101 |
| 13th | 0110 0001 0001 |
| flat 13th | 0101 0001 0001 |
| Dim | 0010 0100 1001 |
| Aug<br>⋮ | 0001 0001 0001<br>⋮ |

ASSIGNMENT MEMORY

DEVICE FOR AND METHOD OF DETECTING AND SUPPLYING CHORD AND SOLO SOUNDING INSTRUCTIONS IN AN ELECTRONIC MUSICAL INSTRUMENT

BACKGROUND OF THE INVENTION

1. Field of the Invention

This invention relates to a device for and method of supplying sounding instructions in an electronic musical instrument.

2. Description of the Related Art

In the prior art, various electronic musical instruments have been proposed which facilitate and simplify the playing of chords; an auto chord operation is one such way of easily playing a chord. In an auto chord operation, while using an auto rhythm operation, a key of a component tone of a chord played on a keyboard as an accompaniment is depressed or depressed and immediately released, whereby an auto chord operation is repeatedly executed.

Another type of auto chord operation is a one finger chord operation. Again, in this one finger chord operation, while using an auto rhythm operation, a key of the keyboard for a chord accompaniment is depressed or depressed and immediately released, whereby a chord type, for example, a major chord, is automatically played repeatedly using the "on" key as a chord root. By simultaneously depressing another key or depressing and immediately releasing that key, the chord type is changed to a minor chord, and by simultaneously depressing a further key or depressing and immediately releasing that key, the chord type is changed to a seventh. Namely, the chord type is changed according to the number of "on" keys.

An example of this chord selection system is disclosed in the specification of U.S. patent Ser. No. 07/706,010.

SUMMARY OF THE INVENTION

An object of the invention is to provide an electronic musical instrument by which not only a selection of chord types can be played but also various types of other sounding operations, including the playing of chords, can be realized.

According to the invention, in response to an instruction for sounding a musical tone, chord tone data is provided together with tone data indicating a single key number, thus permitting a choice of whether or not to select a chord, and further, a choice of whether or not chord tone data is to be output. Accordingly, various types of sounding operations can be carried, for example, a chord being played can be changed together with a single key solo being played, or a chord being played is not changed, i.e., only the single key solo being played is changed.

BRIEF DESCRIPTION OF THE DRAWINGS

FIG. 3 is a view of a chord table 11;

DESCRIPTION OF THE PREFERRED EMBODIMENTS

Summary of the Embodiment

In response to a new "key-on" event, first a solo being played is changed (steps 11 and 12), and according to the on-off state of a chord switch 10 (step 13) it is determined whether or not a chord being played (steps 14 through 22) is to be changed. Namely, a chord being played is changed together with a change of a solo being played, or the chord is not changed, i.e., only the solo being played is changed.

1. Overall Circuitry

Figure 2:
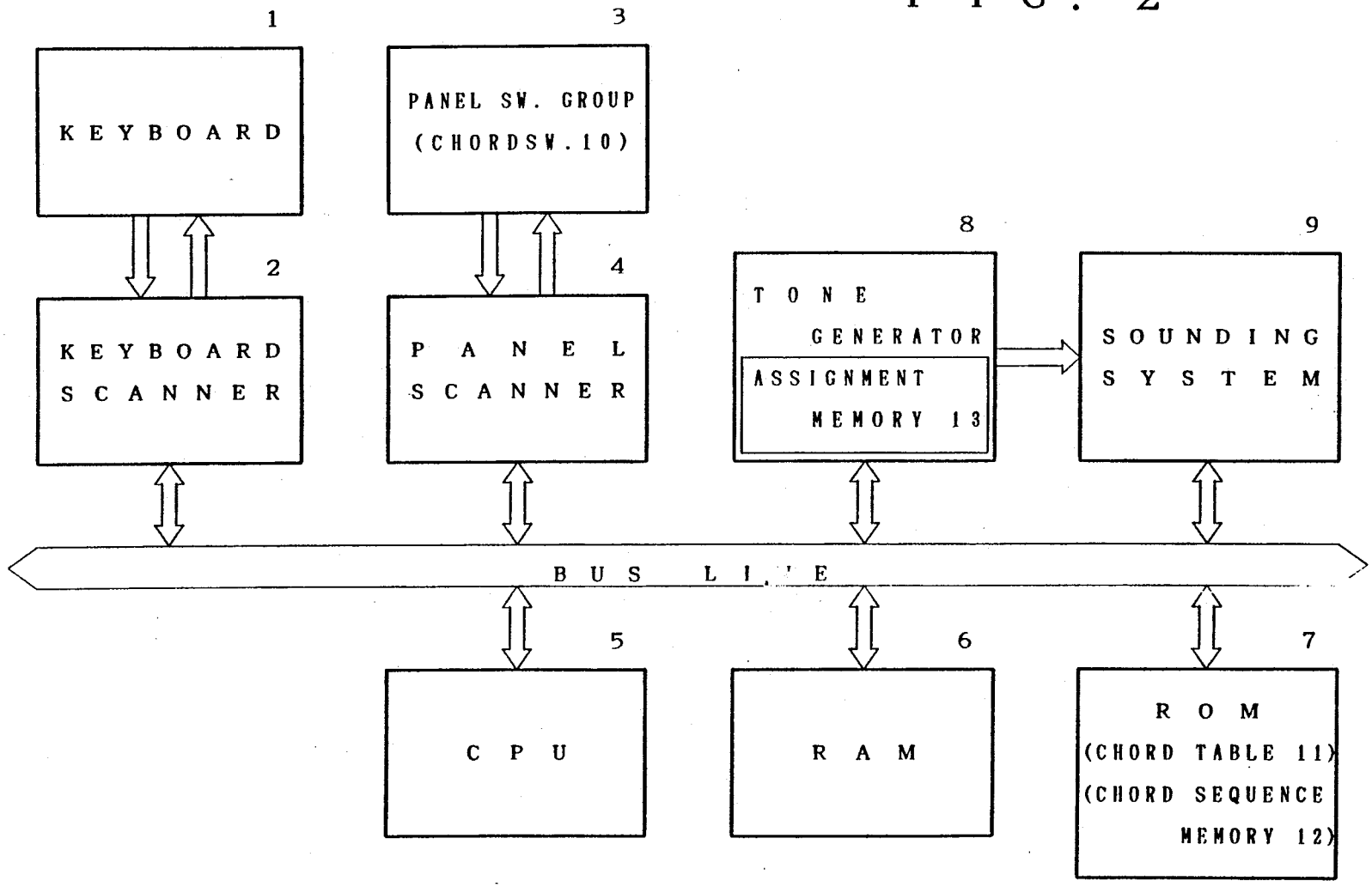
FIG. 2 is a block diagram showing the overall circuitry of an electronic musical instrument.

FIG. 2 shows an overall circuitry of an electronic musical instrument. Individual keys on a keyboard 1 are scanned by a keyboard scanner 2 to thereby detect data indicating a "key-on" or "key-off" event, and the detected data is written to a RAM 6 by a CPU 5. The CPU 5 compares the written data with on-off data for the individual keys and stored in the RAM 6 to determine "on" and "off" events for the keys. Note, the keyboard 1 may be replaced by an electronic string(s) instrument, electronic wind(s) instrument, electronic percussion instrument (pads), or computer keyboard and so forth.

Individual keys in a panel switch group 3 are scanned by a panel scanner 4, to detect on-off data for the individual keys, and the data is written to the RAM 6 by the CPU 5. The CPU 5 compares the written data with on-off data for the individual keys and stored in the RAM 6, to determine "on" and "off" events for the keys.

The panel switch group 3 includes a chord switch 10 for switching between a chord mode and a solo mode. In the chord mode, in response to a new sounding operation of a key of the keyboard 1, tone data of a single key number or tone pitch (hereinafter referred to as solo tone) corresponding to the "on" key is provided, together with chord tone data (hereinafter referred to as chord tone) corresponding to the "on" key. In the solo mode, in response to a new sounding operation of a key of the keyboard 1, tone data of a single key number or tone pitch is provided for normal play. When the mode is switched to the solo mode, the chord tone data in the chord mode immediately before the switch to the solo mode is continually provided. The chord switch 10 may be replaced by a pedal, a foot switch, a knee lever, or a knob, etc.

The RAM 6 stores various routine data, in addition to the data noted above. Among the stored routine data is switch data for switching the chord switch 10, and this data specifies the chord mode ("1") or the solo mode ("0"). A ROM 7 stores programs executed by the CPU 5, corresponding to flow charts described later, and programs for other routines. Further, the ROM 7 contains a chord table 11 and a chord sequence memory 12, and so forth.

The chord table 11 stores chord bit pattern data for various chords; this data being used for determining the chord type and chord root corresponding to "on" keys of the keyboard 1. The chord sequence memory 12 sequentially stores chord play pattern data and this data is modified to form patterns corresponding to the chord type and chord root, for an auto chord operation.

A tone generator 8 generates tone waveform data and the like according to tone data such as a key number (or tone pitch) and touch and tone number (or tone color) input from the keyboard 1 and panel switch group 3.

The tone generator 8, produces tone generation systems for a plurality of, for example, 16, channels using a time division routine, to realized a polyphonic sounding of musical tones. The tone waveform data is sent to a sounding system 9 for sounding, and tone data to which individual channels are assigned is stored in an assignment memory 13.

2. Chord Table 11

FIG. 3 shows the chord table 11. The chord table 11 stores chord bit pattern data with individual bits "1" corresponding to the tone name constituting the chord type, such as major, minor and 7th, or bits "0". Each chord bit pattern data has 12 bits representing respective tone names, such as "C", "C#", "D", "D#" and so forth. The chord bit pattern data uses C as the chord root, but this may be changed to data corresponding to a different chord root, or may represent an inverted chord.

Chord bit pattern data is compared with each "on" key on the keyboard 1, to determine the chord type and chord root. This determination is carried out as follows. The result of a scanning of the accompaniment keyboard (i.e., lower keyboard) of the keyboard 1 or the entirety thereof, i.e., the key on/off data train, is exclusively ORed for each octave, and the exclusively ORed data is compared with the chord bit pattern data. If the compared data are not identical, one of the data is ring shifted by one bit, and another comparison is made. If the compared data are identical, the chord type and the chord root are determined, from the number of times that the ring is shifted. This routine is disclosed in the specification of U.S. patent Ser. No. 07/706,010.

The chord sequence memory 12 stores chord play pattern data for a plurality of measures, and data corresponding to the determined chord noted above is repeatedly read out. The chord play pattern data is for, for example, a C major chord and includes key number data KN, step time data ST, and gate time data GT. The key number data KN is key number data of each tone constituting a chord, the step time data ST represents a time from the start of a piece of music or a measure to the timing of a sounding of the musical tone, and the gate time data GT represents a time or duration of a sounding of the tone. For playing a chord with other chord roots, each key number data KN is shifted according to the chord root difference. In this case also the key number data is partly modified. It is possible to also store chord play pattern data of other chord types, in the chord sequence memory 12.

Each key number data KN as noted above is written to the assignment memory 13, as described later, in the tone generator 8, for sounding the musical tone of the chord. The timing of the start of the sounding is the instant at which the count of a time counter (not shown) becomes identical to the step time data ST. The timing of the end of a sounding is the instant at which the count of the time counter becomes identical to the gate time data GT. The chord determining and playing as noted above also may be executed by other methods. As shown above, when a chord operation is executed at the keyboard 1, the chord tone is continually sounded after a subsequent "key-off" operation. Conversely, the sounding of a solo tone is continued only during the chord operation, and is ended by a "key-off" operation.

3. Assignment Memory 13

Figure 4:
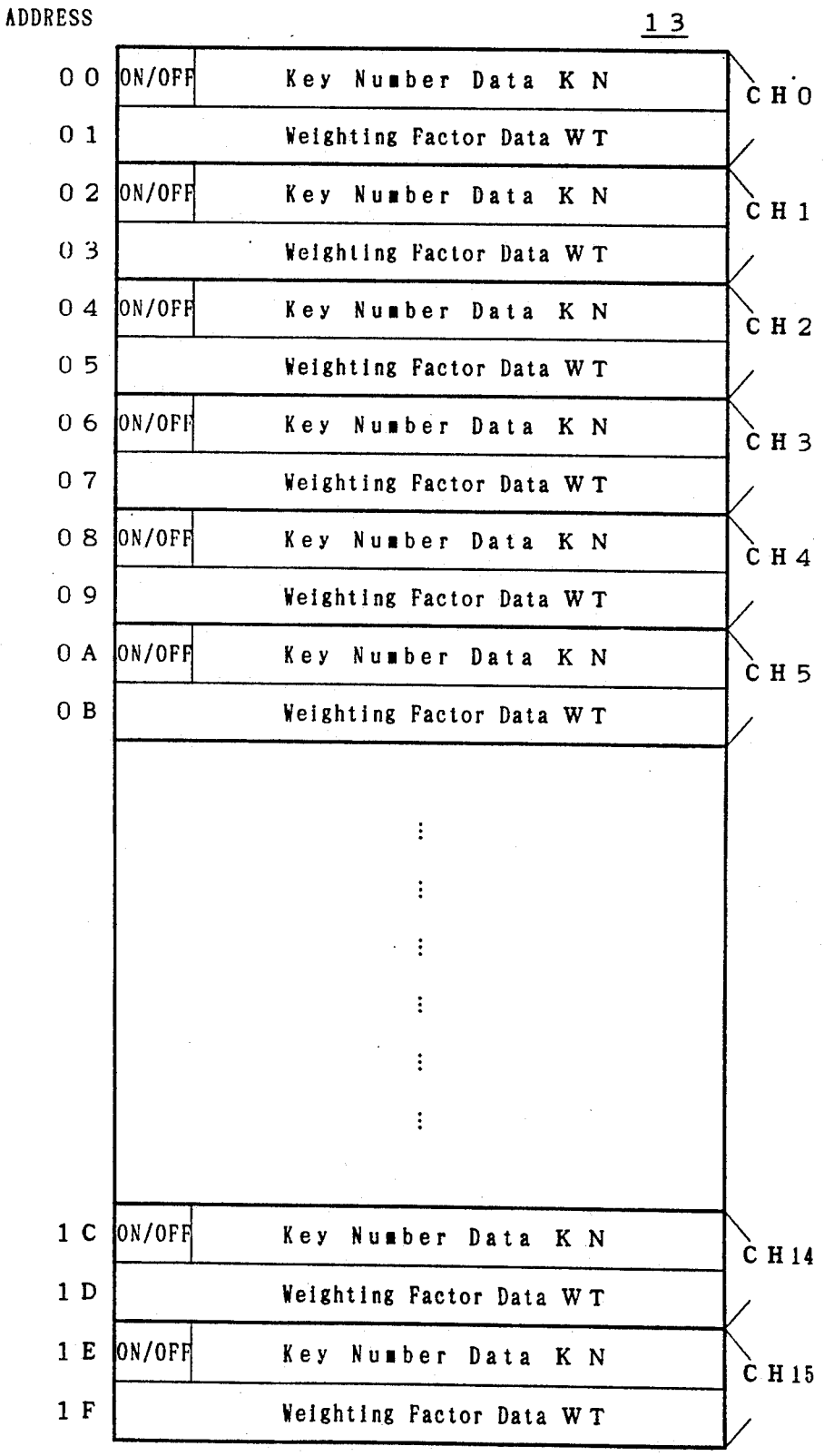
FIG. 4 is a view of an assignment memory 13.

FIG. 4 shows the assignment memory 13. This memory 13 has memory areas for 16 or more channels, and tone data to which 16 or more tone generation channels of the tone generator 8 are assigned is written to the respective memory areas. The tone data includes the key number data KN of chord and solo tones noted above. Note the solo tones can be sounded as bass tones and the chord play and bass play executed at the same time. The bass tones may be replaced by backing tones or the like.

The chord table 11 and chord sequence memory 12 are not read out when the chord switch 10 is set to the solo mode, and therefore, the key number data KN of the chord play pattern data is not written to the assignment memory 13, and the chord tone is not changed with a new "key-on" event, i.e., the previous chord tone is continually sounded.

The tone data written in the individual channel memory areas noted above includes on/off data, key number data KN, and weighting factor data WT, etc. The on/off data indicates the "on" ("1") or "off" ("0") state of each key of the keyboard 1 or the start ("1") or end ("0") of a sounding; the key number data KN indicates the key number of each key of the keyboard 1; and the weighting factor data WT indicates the channel assignment priority and is shown in, for example, the specification of U.S. patent Ser. No. 07/616,182. The assignment memory 13 can store, in addition to the above data, tone number data TN and sound group data GN indicating the tone generation source, and so forth.

4. Overall Routine

Figure 5:
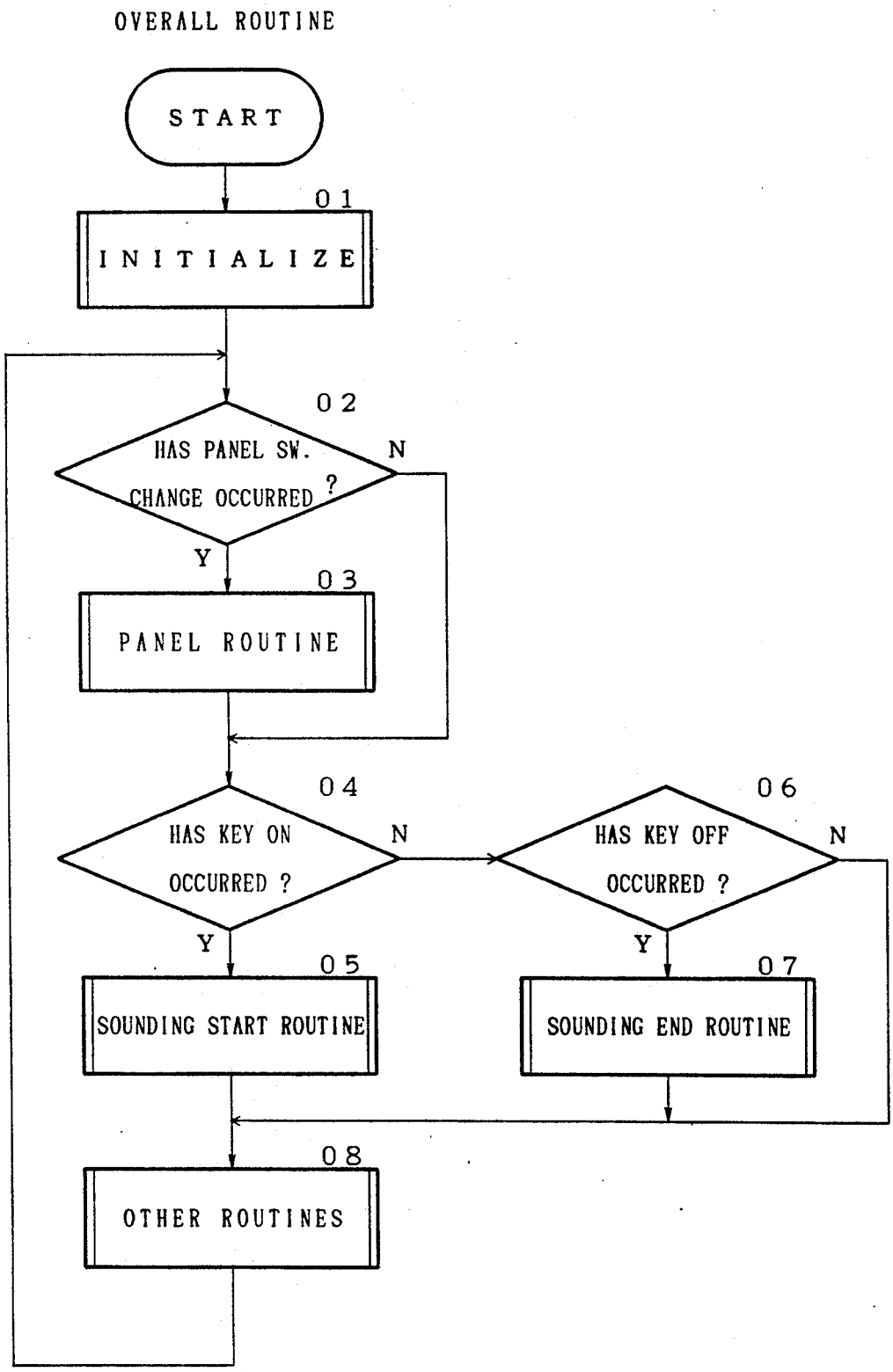
FIG. 5 is a flow chart showing an overall routine.

FIG. 5 shows a flow chart of the overall routine executed by the CPU 5. This routine is started when power is supplied thereto. In this routine, first an initialization is executed (step 01) and then a it is determined if any change has occurred in the state of the panel switch group 3 (step 02). If a change is detected, a panel routine is executed (step 03). Further, in steps 02 and 03, a routine in response to the operation of the chord switch 10 is also executed. In this routine, mode data based on the mode switching of the chord switch 10, indicating the chord mode ("1") or solo mode ("0"), is input to the working register group in the RAM 6.

Subsequently, the keyboard 1 is scanned, and if a "key-on" event is detected (step 04), a sounding start routine is executed (step 05). If a "key-off" event is detected (step 06), a sounding end routine is executed (step 07), and subsequently, other routines are executed (step 08).

5. Sounding Start Routine

Figure 1:
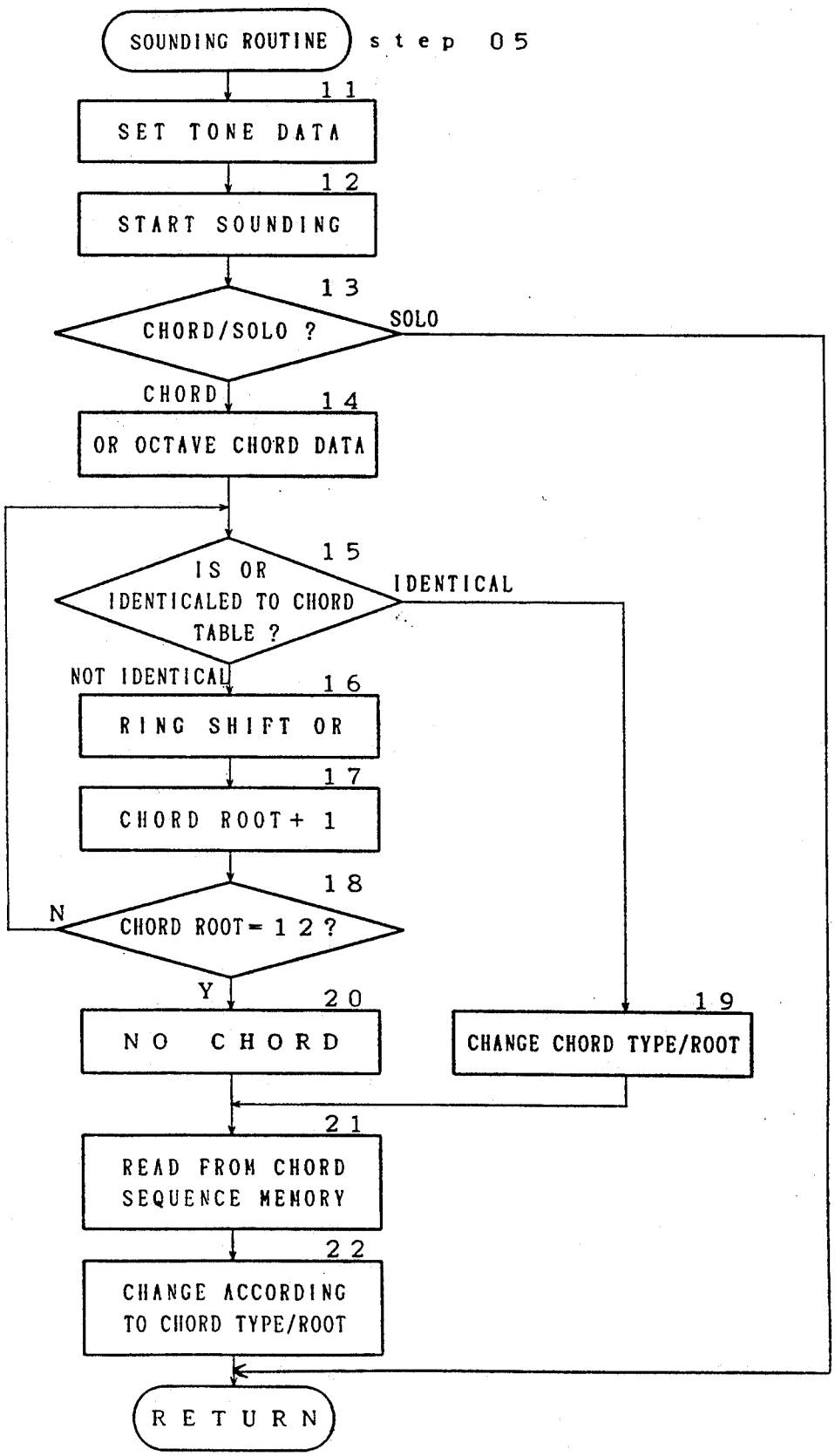
FIG. 1 is a flow chart showing a sounding routine (step 05)

FIG. 1 shows a flow chart of the sounding start routine executed in step 05. In this routine, key number data KN and other data concerning a new "key-on" event detected in step 04 are written in blank channel areas of the assignment memory 13 in the tone generator 8 (step 11), and the on/off data is made "1" to thereby represent an "on" state (step 12), whereby a sounding of a new solo tone corresponding to this "key-on" event is started. The sounding of this solo tone is ended at step 07, as noted above, with a "key-off" event of the key concerned.

Subsequently, it is determined whether the switching data of the chord switch 10 stored in the RAM 6 indicates the chord mode ("1") or solo mode ("0") (step 13). If the solo mode is indicated the subsequent chord routine of steps 14 to 22 is not executed, and if the chord mode is indicated, the chord routine is executed. Accordingly, it can be determined whether only the solo being played is to be changed, or is to be changed together with the chord being played, and thus various ways of sounding can be realized.

In the chord mode, the CPU 5 executes a progressive OR of octave chord data indicating the on/off state of the keys for each octave of the keyboard 1 (step 14), and then chord bit pattern data of each chord type is read from the chord table 11 and it is determined whether this data is identical to the resultant OR of the octave chord data (step 15). If the resultant OR is not identical to all of the chord bit pattern data in the chord table 11, the resultant OR is ring-shifted by one bit (step 16), the chord root data in the RAM 6 is incremented by one (step 17), and the determining of the identity of the resultant OR of the octave chord data and each chord bit pattern data in the chord table 11 is again executed (step 18).

The ring shift of the OR of octave chord data in the step 16, allows a determining of an inversion chord, and further, the chord root can be determined from the number of times the ring is shifted. If chord bit pattern data identical to the OR of octave chord data is found (step 15), the chord type in the chord table 11 corresponding to the identical chord bit pattern data is written to the RAM 6, and chord root data stored in the RAM 6 is made the chord root (step 19). If the chord root data is "0", for example, the chord root is "C"; if the data is "1", the chord root is "C#"; if the data is "2", the chord root is "D"; and if the data is "11", the chord root is "B".

If an identical chord is not found when "12" is reached by the chord root data in step 18, it is determined that a pertinent chord does not exist, and thus the chord root and name renewal routine in step 19 is not executed (step 20). Chord play pattern data corresponding to the chord type and name as detected above, and stored in the RAM 6, are read from the chord sequence memory 12 (step 21), and key number data KN in the read-out data is changed according to the chord root, and further, partly changed according to the chord type (step 22); the changed data being written to the assignment memory 13.

Therefore, the playing of a new chord play is executed according to the "on" key. The on/off for the chord being played is effected according to the step and gate time data, as noted above. The chord may be an arpeggio or the like. It is possible to dispense with the routine of steps 21 to 22 in the chord routine of steps 14 through 22, and to execute only chord detection routine of the steps 14 through 20 for sequentially storing the detected chord type and name.

The above embodiment of the invention is by no means limitative, and various changes and modifications are possible without departing from the spirit and scope of the invention. For example, whether or not a chord is to be played can be selected when a specific sounding is performed, and when a specific mode is selected, and so forth, in addition to the on/off of the chord switch 10. Specific examples thereof are when a repeat play is executed, when an auto play is executed, when a stereo mode is selected, and when a fill-in mode is selected.

Further, it can be determined whether or not a solo is to be played, depending on the on/off state of the chord switch 10 or other switches. In this case, the routine in step 13 is executed before the routine of step 11. Further, it is possible to execute step 08 for the solo mode detected in step 13. Alternatively, the playing of the chord can be ended if the chord switch 10 is set to the solo mode. In this case, if the solo mode is detected in step 13, the sounding end routine is executed for the chord tone being sounded.

Furthermore, the routine in FIGS. 5 and 1 may be executed with respect to auto play data. Namely, auto play data is read from the RAM 6 or ROM 7 or sent through a MIDI interface. In this case, the key number data KN set in step 11 and processed in steps 14 through 18, belongs to the auto play data noted above.

I claim:

1. A device for supplying sounding instructions in an electronic musical instrument comprising:

a plurality of sounding instruction means for generating on and off instructions for sounding a musical tone;

on determining means for determining on instructions of said plurality of sounding instruction means;

off determining means for determining an off instruction of said plurality of sounding instruction means;

first output means for detecting and outputting solo tone data corresponding to the instructions generated by said plurality of sounding instruction means, according to a result of an on determination by said on determining means;

output terminating means for terminating the output of said solo tone data by said first output means, according to a result of an off determination by said off determining means;

second output means for detecting and outputting chord tone data corresponding to the instructions generated by said plurality of sounding instruction means, independent of said solo tone data according to said result of the on determination by said on determining means;

switching means for switching said second output means, independent of said first output means between an operative and an inoperative state;

storing means for storing state data indicating the operative state or the inoperative state switched by said switching means; and switching control means for controlling the switching of said second output means between the operative or inoperative state according to the state data stored in said storing means, independent of said first output means.

2. The device according to claim 1, wherein said first output means includes means for outputting tone data indicating a single key number, and means for sounding a tone corresponding to said tone data indicating a single key number.

3. The device according to claim 1, wherein said second output means includes means for detecting a chord and means for outputting tone data indicating a detected chord.

4. The device according to claim 1, wherein said second output means includes means for storing auto chord play data, means for detecting a chord, and means for reading out auto chord play data corresponding to a detected chord.

5. The device according to claim 4, wherein said second output means further includes means for executing an auto play according to read-out auto chord play data.

6. The device according to claim 3, wherein said second output means further includes means for storing detected chord data.

7. The device according to any one of claims 1, 3 or 4, wherein said second output means holds previous chord tone data output when said switching means is switched to the inoperative state.

8. The device according to claims 1, wherein said the sounding instruction means is key of a keyboard instrument.

9. The device according to claims 1, wherein said the sounding instruction means is string of a string instrument.

10. The device according to claims 1, wherein said the sounding instruction means is wind of a wind instrument.

11. A method of supplying sounding instructions in an electronic musical instrument, comprising the steps of:

(a) providing on and off sounding instructions for a plurality of musical tones;

(b) determining an on instruction for said plurality of musical tones;

(c) determining an off instruction for said plurality of musical tones;

(d) detecting and outputting solo tone data corresponding to the on sounding instructions provided in said step (a), according to a result of the on determination made in said step (b);

(e) detecting and outputting chord tone data corresponding to the on sounding instruction provided in said step (a), independent of the solo tone data, according to the result of the on determination made in said step (b);

(f) terminating the output of said solo tone data in said step (d) according to a result of the off determination made in said step (c);

(g) switching the output of the chord tone data in said step (e) independent of the output of the solo tone data in said step (d), between an operative state and an inoperative state;

(h) storing state data indicating the operative state or the inoperative state switched in said step (g); and (i) controlling the switching of the output of the chord tone data in said step (e) between the operative or inoperative state according to the state data stored in said step (h), independent of the output of the solo tone data in step (d).

12. The method of claim 11, step (d) including the substeps of:

(d) (1) outputting the solo tone data indicating a single key number; and (d) (2) sounding a tone corresponding to the solo tone data indicating the single key number.

13. The method of claim 11, said step (e) including the substeps of:

(e) (1) detecting a chord; and (e) (2) outputting the chord tone data indicating the chord detected in said step (e) (1).

14. The method of claim 11, said step (e) including the substeps of:

(e) (1) storing auto chord play data;

(e) (2) detecting a chord; and (e) (3) reading out the auto chord play data corresponding to the chord detected in said step (e) (2).

15. The method of claim 14, said step (e) further including the substep of (e) (4) executing an auto play operation according to the readout auto chord play data.

16. The method of claim 13, said step (e) further including the substep of (e) (3) storing the chord tone data for the detected chord.

17. The method of claim 11, said step (e) including the substep of (e) (1) holding previous chord tone data when the output of the chord tone data is switched to the inoperative state.

18. The method of claim 14, said step (e) further including the substep of (e) (3) holding previous chord tone data when the output of the chord tone data is switched to the inoperative state.

19. The method of claim 14, said step (e) further including the substep of (e) (4) holding previous chord tone data when the output of the chord tone data is switched to the inoperative state.

20. The method of claim 11, wherein the on and off sounding instructions in said step (a) are provided by a key of a keyboard instrument, string of a string instrument, or wind of a wind instrument.

* * * * *